US005711325A

United States Patent [19]

Kloss et al.

[11] Patent Number: 5,711,325

[45] Date of Patent: Jan. 27, 1998

[54] METHOD OF RINSING IN A DISHWASHER AND DEVICE FOR CARRYING OUT THE METHOD

[75] Inventors: Gerd Kloss, Hüttigweiler; Christa Maurer, Ottweiler; Ludwin Rauber, Tholey-Bergweiler; Reinold Rheia, Neunkirchen, all of Germany

[73] Assignee: Whirlpool Europe B.V., Veldhoven, Netherlands

[21] Appl. No.: 531,878

[22] Filed: Sep. 21, 1995

[30] Foreign Application Priority Data

Sep. 22, 1994 [DE] Germany ..... 44 33 842.2

[51] Int. Cl.[6] ..... B08B 17/00

[52] U.S. Cl. ..... 134/104.1; 210/409; 210/411; 134/111; 134/110; 134/201

[58] Field of Search ..... 134/104.1, 111, 134/110, 201, 153; 68/18 F; 210/353, 354, 355, 401

[56] References Cited

U.S. PATENT DOCUMENTS

| | | | |
|---|---|---|---|
| 2,586,398 | 2/1952 | Vars | 134/58 |
| 2,802,878 | 8/1957 | Levit | 134/104.1 |
| 3,090,391 | 5/1963 | Kaldenberg et al. | 134/104.1 |
| 3,491,780 | 1/1970 | Kaldenberg et al. | 134/104.1 |
| 3,810,480 | 5/1974 | Smith et al. | 134/104 |
| 3,989,054 | 11/1976 | Mercer | 134/104 |
| 4,038,103 | 7/1977 | Grunewald | 174/111 |
| 4,972,861 | 11/1990 | Miloccu et al. | 134/111 |

FOREIGN PATENT DOCUMENTS

| | | | |
|---|---|---|---|
| 441756 | 8/1991 | European Pat. Off. | A47L 15/42 |
| 454640 | 10/1991 | European Pat. Off. | A47L 15/42 |
| 2081286 | 12/1971 | France | A47L 15/00 |
| 1269776 | 6/1968 | Germany | A47L 15/42 |
| 14 28 358 | 11/1968 | Germany . | |
| 37 23721 | 5/1988 | Germany | D06F 39/10 |
| 4131914 | 4/1993 | Germany | A47L 15/42 |
| 413259 | 12/1966 | Switzerland | A47L 15/16 |

*Primary Examiner*—Frankie L. Stinson

*Attorney, Agent, or Firm*—Thomas J. Roth; Joel Van Winkle; Robert O. Rice

[57] ABSTRACT

The invention relates to a method and to a device for carrying out the method for rinsing in a dish washer with a rinse water circuit, in which the rinse water is evacuated from the sump of the wash chamber by means of a circulating pump and, passing through a filter, is supplied to the spray devices in the wash chamber, the filter being cleaned in counterflow to the rinse water by means of introduced cleaning water. During the entire rinsing procedure the filter is cleaned in counterflow, the dirt particles in the filter being kept in suspension. The cleaning water is supplied to the rinse water circuit and preferably removed therefrom.

10 Claims, 2 Drawing Sheets

METHOD OF RINSING IN A DISHWASHER AND DEVICE FOR CARRYING OUT THE METHOD

BACKGROUND OF THE INVENTION

1. Field of the Invention

The invention relates to a method for rinsing in a dishwasher with a rinse water circuit in which the rinsing water is evacuated by a circulating pump from the sump of the wash chamber and, passing through a filter, is supplied to the spray devices in the wash chamber, the filter being cleaned in counterflow to the rinse water by means of supplied cleaning water, and to a device for carrying out the method.

2. Description of the Related Art

A method of the above named type is known from DE-OS 14 28 358. In this known method, a partial flow of the fresh water is used as cleaning water. In order that the filter is acted upon by the cleaning water over its entire exterior, it is necessary to have a spray device surrounding the filter, which is provided with a plurality of nozzles directed at the filter. In this respect it is also possible to use a spray device with only one single nozzle, which is oriented obliquely at the exterior of the filter and in this way causes the filter to move rotarily. The cleaning phase however is separated from the rinsing procedures, as in that case the outflow from the filter is open.

The cleaning procedure in another dishwasher known from DE 37 23 721 A1 operates in a similar manner. Here also, in order to clean the filter, the counterflow principle is used for the cleaning water. The cleaning procedure is effected in special cleaning stages provided in the working cycle. In this case the rotary movement of the filter may be achieved in various ways. Fresh water is likewise used as cleaning water.

SUMMARY OF THE INVENTION

It is the purpose of the invention to provide a method and a device for carrying out the method of the type already mentioned, in which and by means of which cleaning of the filter may be carried out during the entire spraying procedure.

This purpose is fulfilled according to the invention with a method which is characterised in that, during the overall rinsing procedure, cleaning water is supplied in counterflow to the output side of the rotated filter, and in that the rinsing water passing through the filter and the cleaning water are supplied in common to the rinse water circuit. The device for carrying out the method is characterised in that a hollow cylindrical filter is rotatably mounted in a filter housing, in that the filter is closed at one end and is provided at the other end with an input for the rinse water to be filtered, in that the filter housing surrounds the filter with an annular chamber and is provided with an input for the cleaning water, and in that the filter housing, facing away from the input for the rinse water, is utilised as an output for the cleaning water combined with the rinse water in the rinse water circuit.

In the method according to the invention the filter is acted upon by cleaning water during the overall rinsing procedure. This leads to a situation in which the dirt particles cannot come to rest in the filter and are kept permanently in suspension. This permanent cleaning operation is enabled by the fact that the cleaning water is supplied to the rinse water circuit. In order to avoid overcharging the latter, the method is further developed in such a way that a partial flow of the rinse water is used as cleaning water, being removed from the rinse water circuit in front of the filter.

Propulsion of the filter in the method according to the invention may be undertaken in various ways, similarly to prior art, one preferred development being characterised in that, when the lower spray device is in the form of a reaction wheel, the filter is non-rotarily connected to the spray device and is rotated therewith.

In the device for carrying out the method, the supply of cleaning water is such that the input for the cleaning water is in the form of a wide-slot nozzle, which acts upon the filter over its entire vertical dimension.

A constructively simple solution for propulsion and for rotary mounting of the filter is characterised in that the closed end face of the filter is non-rotarily connected by means of a shaft to the rotatably mounted lower spray device, and in that this shaft is rotarily mounted at least in bearing members of the filter housing, which leave free a passage for the rinse water supplied to the rinse water circuit. The rotary mounting can be further improved in that the filter, with its input for the rinse water to be filtered, is freely rotatably mounted in a fluid-tight manner in the filter housing.

BRIEF DESCRIPTION OF THE INVENTION

The invention will be explained in more detail with reference to an embodiment given by way of example and illustrated in the drawing. Shown are:

FIG. 1: a perspective, partly sectional view of a filter device suitable of the method according to the invention, with cleaning device, and FIG. 2: a basic circuit diagram for illustrating the method.

DESCRIPTION OF THE PREFERRED EMBODIMENT

Figure 1:
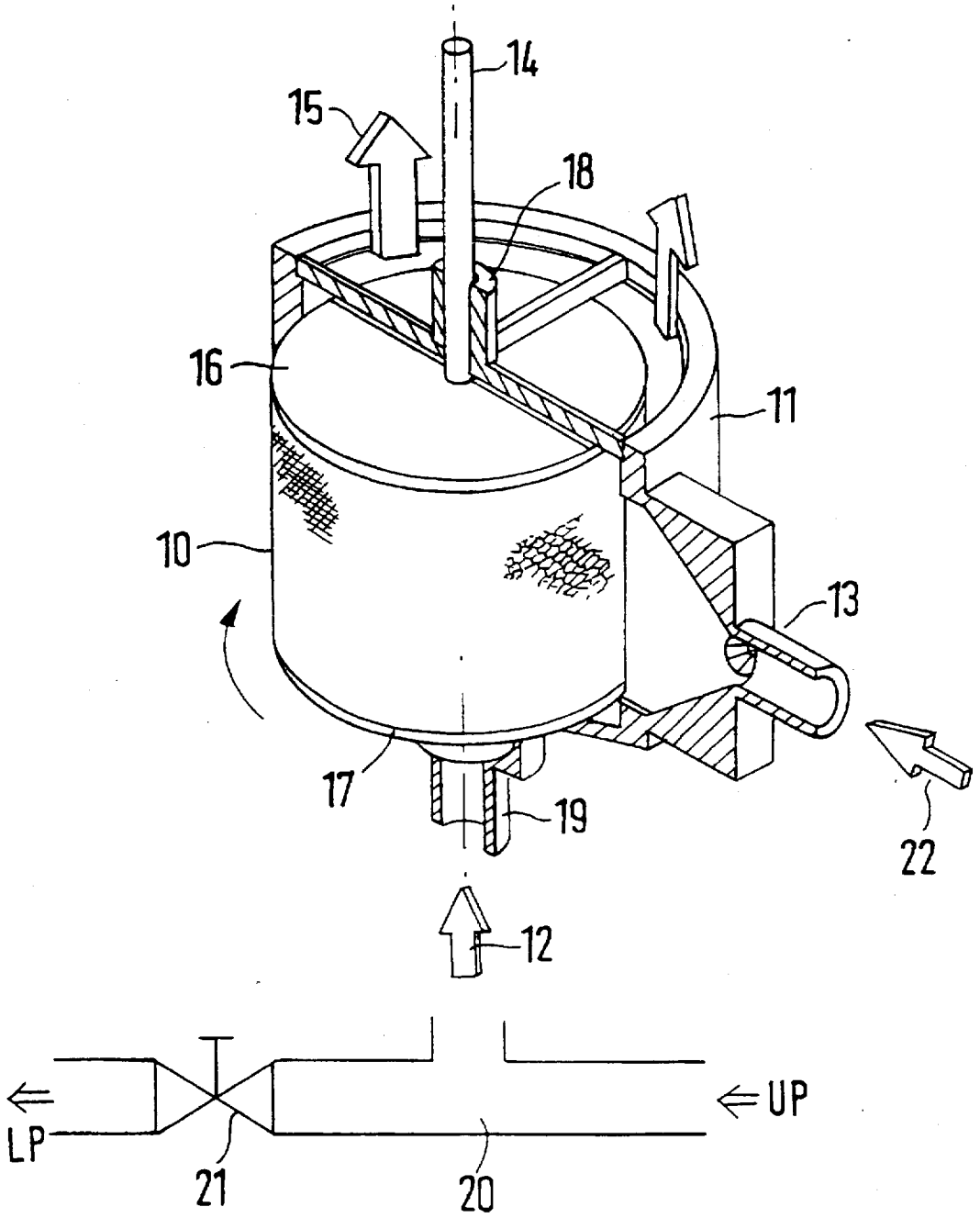

In FIG. 1, a hollow cylindrical filter 10 is entirely enclosed on the end face 16 which is at the top in the drawing. The opposite, lower end face 17 of the filter 10 has an input 19 for the rinse water 12 to be filtered, which is supplied from the circulating pump UP of the rinse water circuit. This rinse water 12 must pass through the filter 10, the dirt particles being retained in the filter 10. The filter 10 is rotatably mounted in a filter housing 11. The filter housing 11 surrounds the filter 10 and forms an annular chamber relative thereto. In addition, the filter housing 11 is provided with an input 13 for cleaning water 22, in the form of a wide-slot nozzle, so that the cleaning water 22 is supplied over the entire height of the filter 10. In order that the entire outer side is acted upon by cleaning water, the filter 10 must be rotated. In the embodiment there is rigidly connected to the upper end face 16 of the filter 10 a shaft 14, which is connected in a way not shown, e.g. non-rotarily, to the lower spray device 24 (FIG. 2) rotatably mounted in the wash chamber, and which is propelled according to the principle of the reaction or Barker's wheel. The upper end face of the filter housing 11 is in the form of a passage 15, from which the rinse water 12 passing through the filter 10, together with the cleaning water 22 supplied through input 13, is passed to the rinse water circuit. In this region the filter housing 11 has simply bearing members 18 for rotarily mounting the shaft 14, so that a sufficiently large cross-section remains for the passage 15.

As is further to be seen from FIG. 1, after the rinsing procedure, and with valve 21 open, the rinse water circuit inclusive of the filter device is emptied with a lye pump LP, 28, the dirt particles retained in the filter 10 flowing out through the input 19.

Due to the constant supply of cleaning water 22 in counterflow to the rinse water 12, the dirt particles cannot settle securely on the inner wall of the filter 10; they are kept in constant suspension in the filter 10, so that in this way automatic cleaning of the filter 10 is achieved, even if said filter has an extremely fine mesh.

Figure 2:
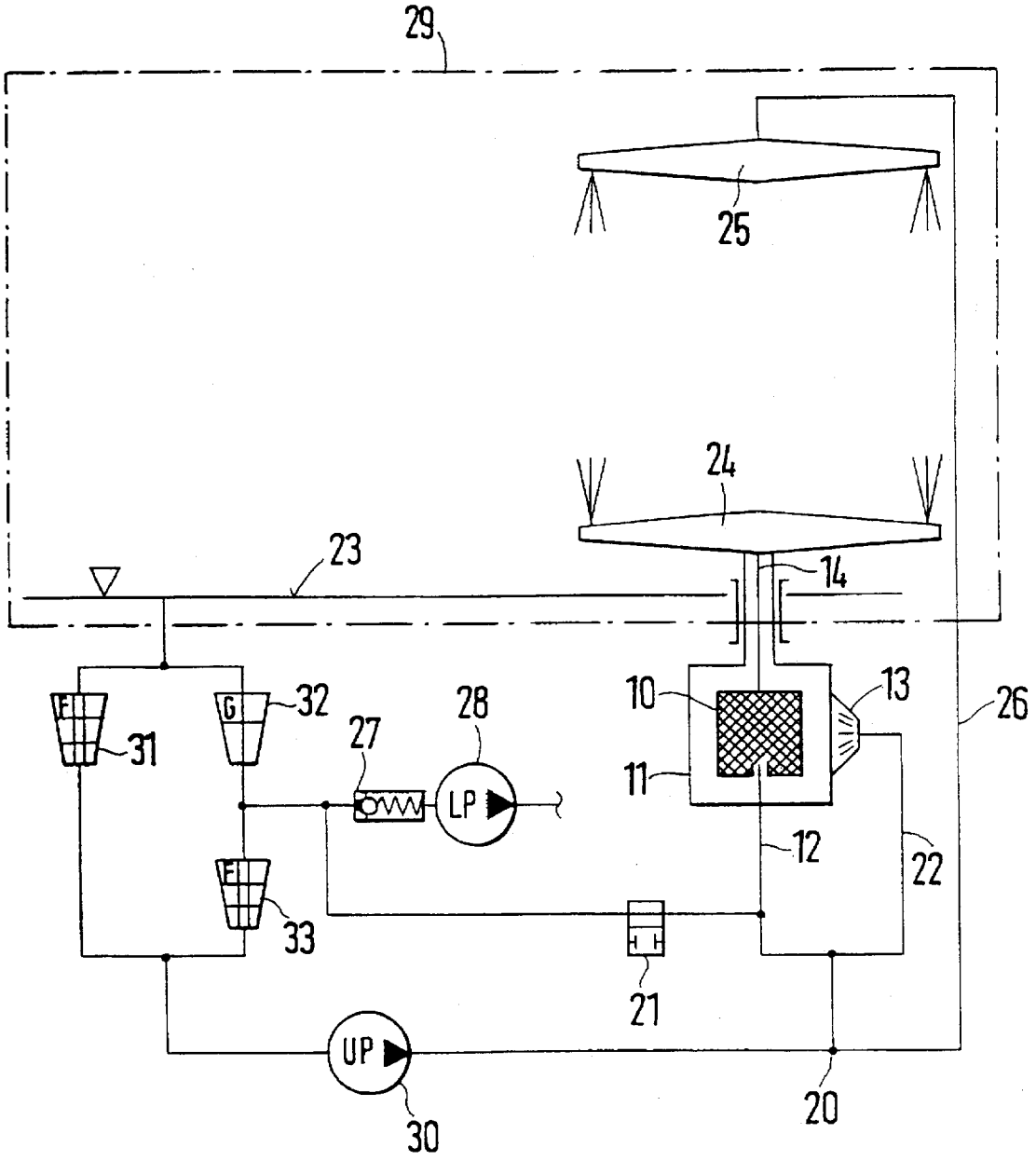

In order to avoid additional load on the rinse water circuit by the cleaning water 22, a portion of the rinse water itself may be used as cleaning water 22. Therefore a partial flow is removed from the rinse water circuit in front of the filter 10, as FIG. 2 shows. By means of this development, control of the rinsing procedures may remain undisturbed, as the amount of rinse water introduced into the rinsing procedure by the permanent cleaning of the filter 10 does not change.

As shown diagrammatically in the illustration according to FIG. 2, an upper spray device 25 and a lower spray device 24 are rotarily mounted in the wash chamber 29 provided with the sump 23. It is propelled in a known way by the emerging rinse water.

During the rinsing procedure, the circulating pump 30, identified as UP, evacuates the collected rinse water in the sump 23 through the fine filter 31 and the coarse filter 32 and fine filter 33 located parallel therewith and mounted in series, and supplies it to the rinse water pipe 20 of the rinse water circuit. At the rinse water pipe 20 the rinse water 12 to be filtered, the partial flow of the rinse water used as cleaning water 22, and the rinse water 26 for the upper spray device 25 are diverted. Both partial flows 12 and 22 are unified at the outlet 15 of the filter device and are supplied to the lower spray device 24. Thus the rinse water circuit is closed. The fine filters 31 and 33 and the coarse filter 32 are manually removed and cleaned. In this arrangement, the filter 10 is preferably in the form of a fine-meshed filter.

After the rinsing procedure, the valve 21 is opened and the rinse water circuit is emptied through the non-return valve 27 and the lye pump LP which is provided with reference numeral 28, the dirt particles passing through the input 19 out of the filter 10.

If the rotary mounting of the filter 10 is to be improved, then the input 19 of the filter 10 may be additionally mounted, yet in a fluid-tight manner in the underside of the filter housing 11.

We claim:

1. A device for cleaning a filter in a dishwasher in which rinsing water is evacuated by a circulating pump from the sump of the wash chamber and, passing through a filter, is supplied to spray devices in the wash chamber, the filter being cleaned in counterflow to the rinse water by means of supplied cleaning water, the device comprising:

a filter housing;

a hollow cylindrical filter rotarily mounted in the filter housing, the filter closed at one end face and provided on the opposite end face with an input for the rinse water to be filtered, an annular chamber surrounding the filter, the annular chamber being formed between the filter housing and the filter and having an input for the cleaning water, and the filter housing, facing away from the input for the rinse water, incorporated as an output for the cleaning water unified with the rinse water in the rinse water circuit.

2. A device according to claim 1, wherein the input for the cleaning water is in the form of a wide-slot nozzle, which acts upon the filter over its entire vertical dimension.

3. A device according to claim 2, wherein the closed end face of the filter is non-rotarily connected by means of a shaft to the rotarily mounted lower spray device, and the shaft is rotarily mounted at least in bearing members of the filter housing, leaving free a passage for the rinse water supplied to the rinse water circuit.

4. A device according to claim 3, wherein the filter, with its input for the rinse water to be filtered, is freely rotatably mounted in a liquid-tight manner in the filter housing.

5. A device according to claim 4, the filter is in the form of a fine-meshed ultrafine filter.

6. A device according to claim 5, wherein the filter housing is heart-shaped at least in the upper cross-sectional area associated with the outlet.

7. A device according to claim 1, wherein the closed end face of the filter is non-rotarily connected by means of a shaft to the rotarily mounted lower spray device, and the shaft is rotarily mounted at least in bearing members of the filter housing, leaving free a passage for the rinse water supplied to the rinse water circuit.

8. A device according to claim 1, wherein the filter, with its input for the rinse water to be filtered, is freely rotatably mounted in a liquid-tight manner in the filter housing.

9. A device according to claim 1, the filter is in the form of a fine-meshed ultrafine filter.

10. A device according to claim 1, wherein the filter housing is heart-shaped at least in the upper cross-sectional area associated with the outlet.

* * * * *